United States Patent [19]

Kawano et al.

[11] Patent Number: 4,561,755

[45] Date of Patent: Dec. 31, 1985

[54] CLEANING DEVICE FOR CLEANING COPY PAPER SEPARATION DEVICE AND TRANSPORT DEVICE IN ELECTROPHOTOGRAPHIC COPYING MACHINE

[75] Inventors: Tadaaki Kawano, Nara; Takashi Nishida, Ibaragi, both of Japan

[73] Assignee: Sharp Kabushiki Kaisha, Osaka, Japan

[21] Appl. No.: 596,900

[22] Filed: Apr. 5, 1984

[30] Foreign Application Priority Data

Apr. 18, 1983 [JP] Japan ..... 58-68772
Apr. 18, 1983 [JP] Japan ..... 58-68773

[51] Int. Cl.[4] ..... G03G 15/00
[52] U.S. Cl. ..... 355/3 SH; 271/307; 271/308
[58] Field of Search ..... 355/3 SH, 14 SH, 15; 271/307, 308, DIG. 2; 15/256.5, 256.51, 256.52

[56] References Cited

U.S. PATENT DOCUMENTS 4,474,368 10/1984 Peter, III et al. ..... 271/308

OTHER PUBLICATIONS

"Plural Cleaning Rolls Assembly", Oskar J. Braun, Xerox Disclosure Journal, vol. 1, No. 1, Jan. 1976, p. 9.

*Primary Examiner*—A. T. Grimley
*Assistant Examiner*—David S. Warren
*Attorney, Agent, or Firm*—Birch, Stewart, Kolasch & Birch

[57] ABSTRACT

An electrophotographic copying machine comprises a cleaning device for cleaning at least the tip of a separation claw used for separating a copy paper from a photoreceptor. The separation claw is pivotably moved between a first position of separating the copy paper and a second position cleaning by the cleaning device. The cleaning device may also be operated to clean a transport device for transporting the copy paper toward a subsequent portion of the apparatus, such as a fixing device.

4 Claims, 2 Drawing Figures

CLEANING DEVICE FOR CLEANING COPY PAPER SEPARATION DEVICE AND TRANSPORT DEVICE IN ELECTROPHOTOGRAPHIC COPYING MACHINE

BACKGROUND OF THE INVENTION

The present invention relates to an electrophotographic copying machine and, more particularly, to a cleaning device for cleaning a separation device and a copy paper transport device in an electrophotographic copying machine, in which the separation device is provided for separating an imaged copy paper from a photoreceptor and the copy paper transport device is activated for transporting the imaged copy paper into a fixing device.

An electrophotographic copying machine produces on a photoreceptor an electrostatic latent image corresponding to a pattern image of a document such as a manuscript or book to be copied. A developing device is provided so that toner particles are electrostatically transferred and adhered to the latent image on the photoreceptor, so that the latent image becomes visible as a toner image. The toner image is transferred onto a copy paper via a transfer corona discharger.

Conventionally, to separate the imaged copy paper from the photoreceptor, either mechanical separation means or electrostatic separation means are provided. As the mechanical separation means, a separation claw is provided facing the photoreceptor for separating the copy paper when the separation claw becomes somewhat close to the surface of the photoreceptor.

Conventionally, some of the toner particles remain on the photoreceptor even after most of the toner particles disposed on the photoreceptor are transferred onto the copy paper during the image transfer. Therefore, the separation claw being positioned close to the surface of the photoreceptor may scoop the remaining toner particles from the photoreceptor, so that the tip of the separation claw may become dirty with the toner particles. Thus, the scooped toner particles may drop on the imaged copy paper to thereby degrade the copy paper cleanness.

Further, conventionally a cleaning device is provided for removing the remaining toner particles from the photoreceptor after the corona image transfer. The cleaning device is positioned above the transport way through which the copy paper is transported into a fixing device. Therefore, the cleaning device may drop the collected toner particles onto the transport way. The dropped toner particles may also damage the imaged copy paper.

SUMMARY OF THE INVENTION

Accordingly, it is an object of the present invention to provide a novel cleaning device for cleaning a separation device which separates a copy paper from a photoreceptor in an electrophotographic copying machine, so that the copy paper is not contaminated.

It is another object of the present invention to provide a novel cleaning device for cleaning a separation claw which separates a copy paper from a photoreceptor.

It is a further object of the present invention to provide a novel cleaning device for cleaning a copy paper transport device transporting a copy paper toward the subsequent section.

It is a further object of the present invention to provide a novel cleaning device for cleaning a separation device and a copy paper transport device, the separation device being activated for separating the imaged copy paper from a photoreceptor and the copy paper transport device being activated for transporting the imaged copy paper.

Briefly described, in accordance with the present invention, an electrophotographic copying machine comprises a cleaning device for cleaning at least the tip of a separation claw separating a copy paper from a photoreceptor. The separation claw is pivotably moved between a first position of separating the copy paper and a second position for cleaning itself by the cleaning device. The cleaning device may be operated to clean a transport device transporting the imaged copy paper into the subsequent section, such as a fixing device.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
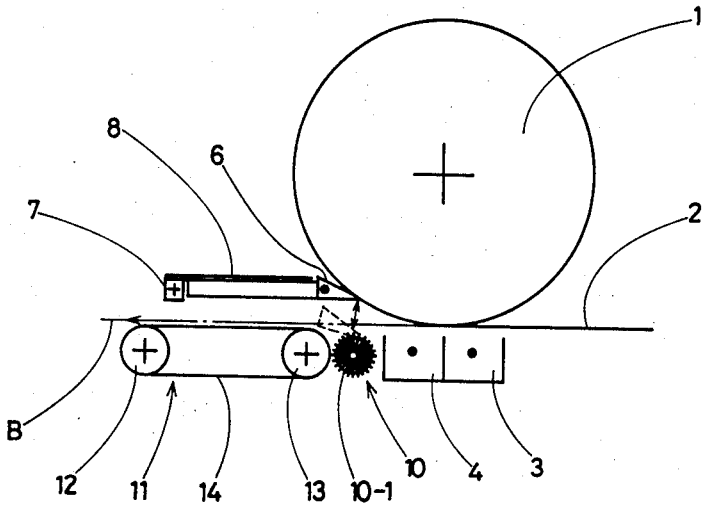
FIG. 1 is a side view of a cleaning device for cleaning a separation device such as a separation claw, and a transport device according to the present invention.
Figure 2:
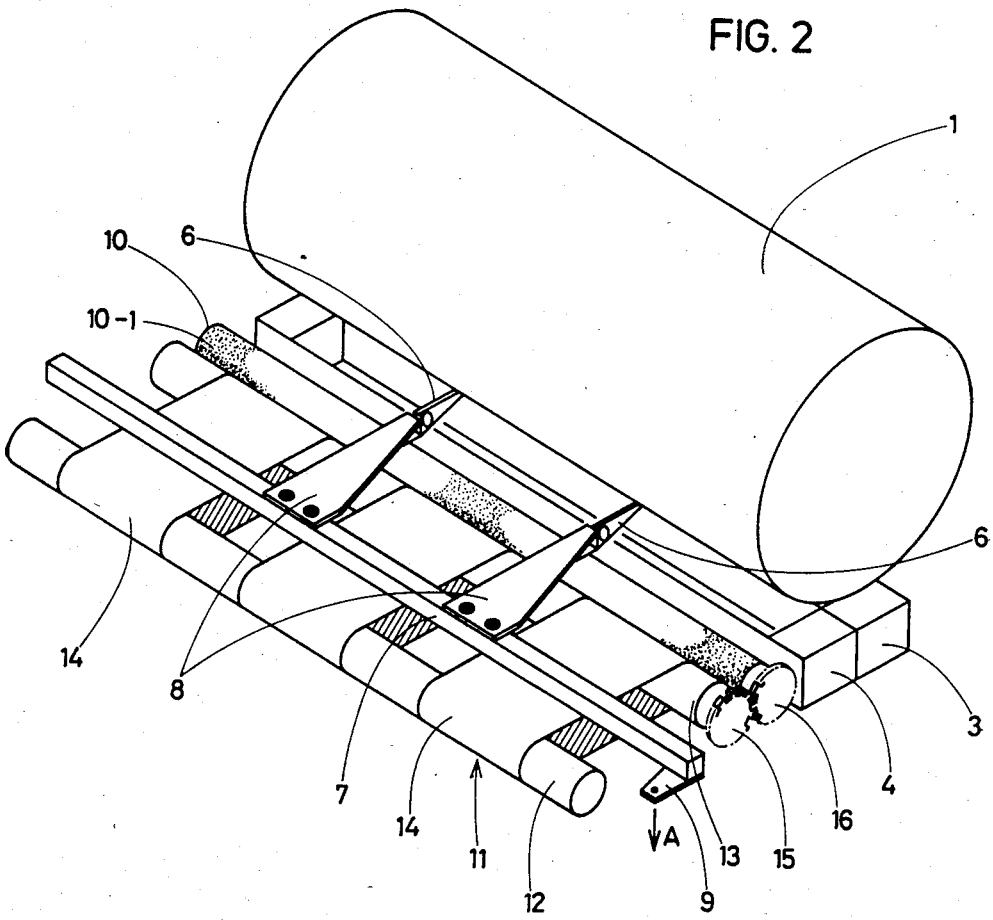
FIG. 2 is a perspective view of the cleaning device of FIG. 1.

Referring now to FIGS. 1 and 2, the copying machine comprises a photoreceptor 1 disposed around a rotational drum. The photoreceptor 1 comprises a photoconductive layer on the outermost surface. Although not specifically shown in FIG. 1, a discharger may be provided for charging the photoreceptor 1, a light exposing device may be provided for exposing light toward the document mounted onto a document table as the document table is reciprocated in accordance with the rotation of the drum and the photoreceptor 1, so that the reflected light beams are incident onto the photoreceptor 1 through an optical system to form an electrostatic latent image. A developing device may be provided for developing the latent image with toner particles to form a tone image. A transfer discharger 3 is provided for transferring the toner image onto a copy paper 2 picked up from a number of copy papers stored within a cassette by applying a corona charge having the same polarity of the voltage of the latent image on the photoreceptor 1 and a polarity opposite to the charges of the toner particles attached to the photoreceptor 1. In parallel with the transfer corona discharger 3, an AC corona discharger 4 is provided for providing an AC corona, after the corona transfer and behind the copy paper 2 to weaken the attraction of the copy paper 2 to the photoreceptor 1. Paper pick-up rollers may be provided for picking up a single copy paper 2 from the paper in the cassette. Paper feed rollers may be provided for feeding the picked-up copy paper 2 into the transfer charger 3. A charge removing charger may be provided for charging the photoreceptor 1 to a polarity opposite to the polarity of the remaining charges on the photoreceptor 1 to remove the residual charges from the photoreceptor 1. A light device may be provided for flooding the photoreceptor 1 with light to remove the residual charges from the photoreceptor 1. A pair of fixing rollers may be provided for pressing the toner image onto the copy paper 2 to fix the toner image thereon. A pair of exhaust rollers may be provided for expelling the copy paper from the body of the copying machine placing the imaged paper onto an expel tray.

It is to be noted that the application of the present invention should not be limited to the copying machine of the type as shown in FIG. 1.

According to the present invention, a separation claw 6 is positioned so as to confront the surface of the photoreceptor 1 after it passes the AC corona discharger 4. The separation claw 6 is attached to a support plate 8 fixed to a rotatable shaft 7. The tip of the separation claw 6 is close to or in contact with the photoreceptor 1. At one end of the rotatable shaft 7, a lever 9 is fixed and an absorption means, such as a solenoid (not shown), is coupled thereto. When the absorption means is energized, the lever 9 is pulled down in a direction A, so that the separation claw 6 moves close to the surface of the photoreceptor 1 around the shaft 7. To the contrary, when the absorption means is not energized, the separation claw 6 is lowered far from the surface of the photoreceptor 1 due to the fact that the weight of the claw 6 or the energization of a spring directs the separation claw 6 to pivotably move down the transport way B of the copy paper 2. That is, the separation claw 6 is pivotably moved between the separation position of separating the copy paper 2 from the photoreceptor 1, as shown in the true line of FIG. 1, and the cleaning position of cleaning the tip of the claw 6, as shown in the dotted line of FIG. 1.

At the cleaning position symmetrical with the separation position, a cleaning means 10 is provided for coming into contact with at least the tip of the separation claw 6 to clean it. The clening means 10 comprises a soft hair 10-1, such as a fur blush, the soft hair 10-1 being circular and rotated so as to come into contact with a copy paper transport device 11. The cleaning device 10 rotates because the rotation of the transport device 11 conducts the cleaning device 10. The transport means is provided for transporting the separated coy paper 2 toward a fixing device.

The transport device 11 comprises a drive roller 12, a follower roller 13, and a transport belt 14 entrapped between the driving roller 12 and the follower roller 13. A first gear 15 is fixed to an end of the shaft of the follower roller 13. A second gear 16 is connected to an end of the shaft of the cleaning means 10. The cleaning means 10 is rotated in unison with the operation of the transport device 11. The cleaning device 10 thereby continuously cleans the transport belt 14 and the follower roller 13 of the transport device 11. It may not be limitative that the cleaning device 10 is rotated in conjunction with the operation of the transport device 11. It may be possible that the cleaning device 10 is rotated by any other driving device.

With the above-described arrangement, the toner image formed on the photoreceptor 1 is electrostatically transferred to the copy paper 2 via the transfer corona discharger 3. The thus imaged copy paper 2 is electrostatically close to the surface of the photoreceptor 1. The AC corona discharger 4 is activated for weakening the attraction of the copy paper 2 to the photoreceptor 1. Thus, the copy paper 2 may be automatically separated from the photoreceptor 1 owing to the tightness and the weight of the paper 2. The separated copy paper 2 soft-lands on the transport device 11, so that it is transported by the transport belt 14 toward the subsequent portion, such as the fixing device.

Depending on the difference of the surface level on the photoreceptor 1, the kind, the size, the rotation speed of the photoreceptor 1, the kind of the copy paper, and the sorrounding conditions, the copy paper 2 cannot separate from the photoreceptor 1 because the AC corona discharger 4 cannot sufficiently weaken the close attraction of the copy paper 2. In such a case, the separation claw 6 is utilized to separate the copy paper 2 from the photoreceptor 1 because the edge of the copy paper 2 is separated by the separation claw 6 when the copy paper 2 reaches the position corresponding to the separation claw 6, and, thereafter, it is separated with the help of the tightness and weight of itself.

Thus, when the copied paper 2 is separated and the rear edge of the copied paper 2 passes the part of the transport device 11 corresponding to the position of the separation claw 6, the absorption means is de-energized in synchronization with this timing. While the absorption means is energized, the tip of the separation claw 6 is close to or in contact with the photoreceptor 1. When the absorption means is de-energized, the separation claw 6 is pivotably moved by the weight of the claw 6 per se around the shaft 7 until the tip of the claw 6 comes into contact with the cleaning means 10 beyond the transport way B. The tip of the claw 6 is thereby cleaned by the cleaning means 10, so that the toner particles possibly attached to the tip of the claw 6 are removed.

Next, a new copy paper is forwarded at the transfer portion, and the absorption means is energized in synchronism with such a condition. The separation claw 6 is pivotably lifted toward the photoreceptor 1 around the shaft 7. Since the soft hair 10-1 of the cleaning device 10 is rotated, the transport belt 14 and the follower roller 13 being in contact with the soft hair 10-1 are cleaned to thereby remove the toner particles and any dust therefrom. Thus, the transport device 11, especially, the transport belt 14 and the follower roller 13, are continuously cleaned.

As stated above, in accordance with the present invention, the separation claw 6 is cleaned by the cleaning means 10 per each copy, so that it is void of toner particles and any dust. The copy paper 2 cannot be contaminated by the separation claw 6. Since the claw 6 is cleaned when positioned beneath the transport way B, removed toner particles can be prevented from falling on the copy paper 2. Further, the transport belt 14 and the feed roller 13 are cleaned by the cleaning means 10, continuously, so that the rear side of the copy paper 2 cannot be contaminated.

In the above description, the soft hair 10-1 is exemplified. However, the cleaning device of the present invention should not be limited to such a means. Further, it may be evident that the AC corona discharger 4 can be removed, so that the separation claw 6 solely separates the copy paper 2.

While only certain embodiments of the present invention have been described, it will be apparent to those skilled in the art that various changes and modifications may be made therein without departing from the spirit and scope of the present invention as claimed.

What is claimed is:

1. An electrophotographic copying machine inclusive of a cleaning device which cleans a copy paper separation device comprising:

a separation device comprising a claw means for separating an imaged copy paper from a photoreceptor surface;

a transport device for transferring said imaged copy paper from the surface of said photoreceptor to a subsequent station;

means for pivotably moving said claw means between a first position where said claw means is positioned close to said photoreceptor to separate said copy paper from said photoreceptor and a second position beneath a transport path for transporting said copy paper by said transport device; and cleaning means for cleaning at least a tip of said claw means when said claw means is positioned in said second position said cleaning means being positioned juxtapositioned to said transport device beneath said transport path for said copy paper.

2. The copying machine of claim 1, wherein said cleaning means comprises a ssoft hair roll which contacts said tip of said claw means and said transport device.

3. The copying machine of claim 1, further comprising means for rotating said cleaning means.

4. The copying machine of claim 2, wherein said transport device comprises a transport belt, a drive roller and a follower roller and said soft hair roll cleans respective surfaces of said transport belt and follower roller.

* * * * *